US005329292A

United States Patent [19]

Nishioka et al.

[11] Patent Number: 5,329,292

[45] Date of Patent: Jul. 12, 1994

[54] DISPLAY CONTROLLER FOR A FLAT DISPLAY APPARATUS

[75] Inventors: Kiyokazu Nishioka, Odawara; Masahiro Jinushi; Nobuo Tsuchiya, both of Fujisawa, all of Japan

[73] Assignees: Hitachi, Ltd., Tokyo; Hitachi Video & Information System, Inc., Yokohama, both of Japan

[21] Appl. No.: 796,678

[22] Filed: Nov. 25, 1991

[30] Foreign Application Priority Data

Nov. 30, 1990 [JP] Japan ..... 2-328891

[51] Int. Cl.[5] ..... G09G 1/28

[52] U.S. Cl. ..... 345/199; 345/186

[58] Field of Search ..... 340/703, 701; 358/75, 358/78; 345/199, 186

[56] References Cited

U.S. PATENT DOCUMENTS 4,853,681 8/1989 Takashima ..... 340/703
4,935,730 6/1990 Kosuka ..... 340/703
4,942,389 7/1990 Hinami ..... 340/703
5,003,380 3/1991 Hirota ..... 358/75
5,038,300 8/1991 Seiler et al. ..... 340/701
5,075,767 12/1991 Takaragi ..... 358/75

*Primary Examiner*—Ulysses Weldon
*Assistant Examiner*—Amare Mengistu
*Attorney, Agent, or Firm*—Antonelli, Terry, Stout & Kraus

[57] ABSTRACT

A display controller of a flat display apparatus which performs multiple color display and variable color display for display data read out of a lookup table. The lookup table comprises a parallel lookup table which has n ($n \leqq 2$) registers for storing color information and m selectors which receive n pieces of color information independently from the n registers, each select one of n pieces of color information, and deliver m pieces of color information simultaneously. The controller further comprises a data selector which selectively delivers the output of another register to in the parallel lookup table in place of the register to which the read access has been made.

11 Claims, 15 Drawing Sheets

DISPLAY CONTROLLER FOR A FLAT DISPLAY APPARATUS

BACKGROUND OF THE INVENTION

This invention relates to a display controller for a flat display apparatus which is suitable for such information processing apparatus as work stations using flat display panels such as liquid crystal display panels.

In currently available display controllers intended for fine display of information, as employed in work stations and the like, it is a general convention to speed up the multiple color and variable color functions based on a lookup table, as described in Japanese Patent Publication No. 54-37943. The following explains the above-mentioned prior art with reference to FIGS. 1 and 2.

FIG. 1 is a block diagram of the conventional display controller. In the figure, indicated by 1 is an oscillator which generates a base clock signal (dot clock signal) 2, with each clock pulse corresponding to a pixel (dot) of the display, and 3 is a timing signal generation circuit which produces various timing signals from the dot clock signal 2. A character clock signal for of a 8-dot interval is produced by the timing signal generation circuit 3, and a display address generation circuit 5 repeatedly generates display addresses for one frame in accordance with the character clock signal 4. A memory address (display address) produced on bus 6 by the display address generation circuit 5, display memories 71 and 72 store display information provided by a computer MPU (not shown), and 8-bit display data on buses 81 and 82 are read out of the display memories (A, B) 71 and 72 in accordance with the display address on bus 6. Each address of both display memories 71 and 72 is assigned to a display dot on the liquid crystal display (LCD) panel, and accordingly 8-bit display data 81 and 82 read out of these memories are in a bit-by-bit correspondence.

Indicated by 10 is a parallel-to-serial conversion circuit which converts the 8-bit display data into bit-serial dot data (display data) 111 and 112, and 12 is a lookup table with 2-bit input and 4-bit output in this example which is used for multiple color display and variable color display.

FIG. 2 shows the structure of the lookup table 12. In the figure, indicated by 261 is color information provided by the computer MPU (not shown), 262 is a write address provided by the computer MPU, 121 is a decoder which decodes the write address 262 to produce four kinds of outputs, 122*a* through 122*d* are write signals which are the decoded outputs of the decoder 121, and 123*a* through 123*d* are 4-bit registers which hold display color information 261 by being strobed by the write signals 122*a*–122*d*, respectively. Accordingly, the computer MPU selects one of the registers 123*a*–123*d* by issuing the write address 262 of a certain value thereby to set the color information 261 in it.

Indicated by 124*a* through 124*d* are 4-bit color information read out of the registers 123*a*–123*d*, 125 indicates a selector which selectively conducts one of the four inputs (color information 124*a*–124*d*) in response to a 2-bit value of the dot data 111 and 112, and 13 is 4-bit color data selected by the selector 125. Accordingly, based on the values of the dot data 111 and 112 supplied to the lookup table 12, one of color information held in the registers 123*a*–123*d* is selected and delivered as color data 13.

Returning to FIG. 1, indicated by 17 is a CRT display unit, which displays the color data 13 from the lookup table 12 as visual information of m dots by n lines. Vertical and horizontal sync signals 18 and 19 are produced from the dot clock 2 by the timing generation circuit 3.

Next, the operation of the display controller arranged as described above will be explained.

Display information stored in locations pointed to by the display address produced on bus 6 which is provided by the display address generation circuit 5 is read out of the display memories 71 and 72. Both information in 8-bit length is fed to the parallel-to-serial conversion circuit 10 as display data 81 and 82. The parallel-to-serial conversion circuit 10 converts the 8-bit display data 81 and 82 into bit-serial data, with each bit representing a dot, and the resulting dot data 111 and 112 are fed to the lookup table 12.

The lookup table 12 stores four sets of color information which have been preset by the computer MPU (not shown) as mentioned above, and it selectively delivers one of four sets of color information as color data to the CRT display unit 17 in response to the value of dot data 111 and 112.

The display address generation circuit 5 generates the display addresses for one frame sequentially, and consequently the CRT display unit 17 is supplied with display data for one frame as color data 13. The CRT display unit 17 displays the dot-wise color data 13 as visual information, and in response to the horizontal sync signal 19, which is produced after m dots have been displayed, it displays data on the next line. This operation is repeated for n lines, and the sequence returns to the top line in response to the vertical sync signal 18.

Through the iteration of the above operations, display information stored in the display memories 71 and 72 is displayed on the CRT display unit 17.

Generally, conventional display apparatus used for such information processing apparatus as work stations and personal computers have their display controller contemplating the reduction of noises created on the display screen during a read access made by the MPU to the lookup table which converts data read out of the display data memory (will be termed "VRAM") into data having the format of the display unit during the period when display data is fed to the screen (will be termed "display period"), as described in Japanese Patent Unexamined Publication No. 62-161194.

Recently, work stations are in a transition of demand from the desktop type using a CRT display unit to the laptop type which is more compact and space-saving by employing a liquid crystal display panel. In order to meet the demand, it is conceivable that the conventional display controller is provided with an additional interface circuit for the liquid crystal panel and is fabricated as a LSI device including peripheral circuitry thereby to attain further compactness. However, the above-mentioned prior art involves difficulties in LSI fabrication, particularly CMOS (Complementary Metal Oxide Semiconductor) LSI fabrication. The problems will be explained with reference to FIG. 3 which is a block diagram of a display controller derived from FIG. 1, with an interface circuit for such a flat display panel as a liquid crystal display panel being added thereto. Portions identical to those of FIG. 1 are referred to by the same symbols and their same arrangement and operation will not be explained.

In the figure, indicated by 15 is a serial-to-parallel conversion circuit which converts the color data 13 read out of the lookup table 12 into data of a certain number of bits for the flat display panel in accordance with the dot clock signal 2, and 161 through 164 are color data provided by the serial-to-parallel conversion circuit 15, i.e., four 4-bit color data for four dots in this example.

Indicated by 171 is a flat display panel having a screen area of m dots by n lines, 20 is a display enable signal indicative of the display period, and 21 is a data shift signal. The flat display panel 171 operates to latch the color data 161-164 sequentially in response to the data shift signal 21 and, after color data of m dots for one line has been latched, displays the data as visual information in response to the horizontal sync signal 19 which is produced for one clock period for every line. This operation is repeated for n lines thereby to display a frame of data.

Assuming that the flat display panel 171 has a resolution of 1,280 dots by 1,024 lines and a frame frequency of 70 Hz, the dot clock signal 2 needs to have a frequency $f_{DCLK}$ as follows.

$$f_{DCLK} \geqq 1{,}280 \times 1{,}024 \times 70 \simeq 92 \text{ MHz}$$

Accordingly, the timing signal generation circuit 3, parallel-to-serial conversion circuit 10, lookup table 12 and serial-to-parallel conversion circuit 15 need to operate at a speed comparable to 100 MHz, which is too fast for the high-density circuit integration based on the usual CMOS gate arrays or the like due to difficulties in the timing design (if not impossible) and also increased power dissipation.

SUMMARY OF THE INVENTION

The present invention is intended to overcome the foregoing prior art deficiencies, and its prime object is to provide a display control method and apparatus which do not incur the timing and power dissipation problems due to a high operating frequency when designed for high-density integration with CMOS gate arrays or the like.

Another object of this invention is to provide a display data control method and apparatus which reduce screen noises created by intermixing of data other than correct display data in the display output due to a read access made by the MPU during the display period.

The first objective is achieved by reading multiple sets of color information simultaneously out of the lookup table and through the parallel operation of circuit systems in the display controller.

The second objective is achieved through-the operation of the lookup table such that for a circuit configuration of the k-bit parallel operation ($k \geqq 2$), a read access to the n-th ($n \leqq k$) lookup table by the MPU during the display period is fulfilled by the delivery of display data from the (n+1)th or (n−1)th lookup table. Alternatively, it is achieved through the delivery of a mean value of display data from the (n+1)th and (n−1)th lookup tables for display data for the n-th lookup table. Alternatively, it is achieved through the delivery of display data for the n-th lookup table by evaluating it based on interpolation of display data of the first, second, . . . , (n−1)th, (n+1)th, (k−1)th and k-th lookup tables.

The parallel read operation of the lookup tables for color information for display eliminates serial operations in the display controller, and it allows a lower dot clock frequency and makes it possible to deal with the timing and power dissipation problems in accomplishing a high density integration.

In the circuit configuration of the k-bit ($k \geqq 2$) parallel operation, a read access to the n-th lookup table by the MPU during the display period is detected and then display data of the (n+1)th or (n−1)th lookup table is delivered for it, resulting in the same display data of the n-th, (n+1)th and (n−1)th lookup tables, and consequently screen noises can be reduced.

Through the delivery of a mean value of display data of the (n+1)th and (n−1)th lookup tables for the display data of the n-th lookup table, the differences of tones or colors between the (n−1)th and n-th display data and the n-th and (n+1)th display data are equalized, and consequently screen noises can be reduced.

Through the delivery of display data by evaluating it based on the interpolation of display data of the first, second, . . . , (n−1)th, (n+1)th, . . . , (k−1)th and k-th lookup tables, display data which is approximate to the inherent display data of the n-th lookup table is displayed, and consequently screen noises can be reduced.

DESCRIPTION OF THE PREFERRED EMBODIMENTS

An embodiment of the present invention will be described with reference to the drawings.

Figure 4:
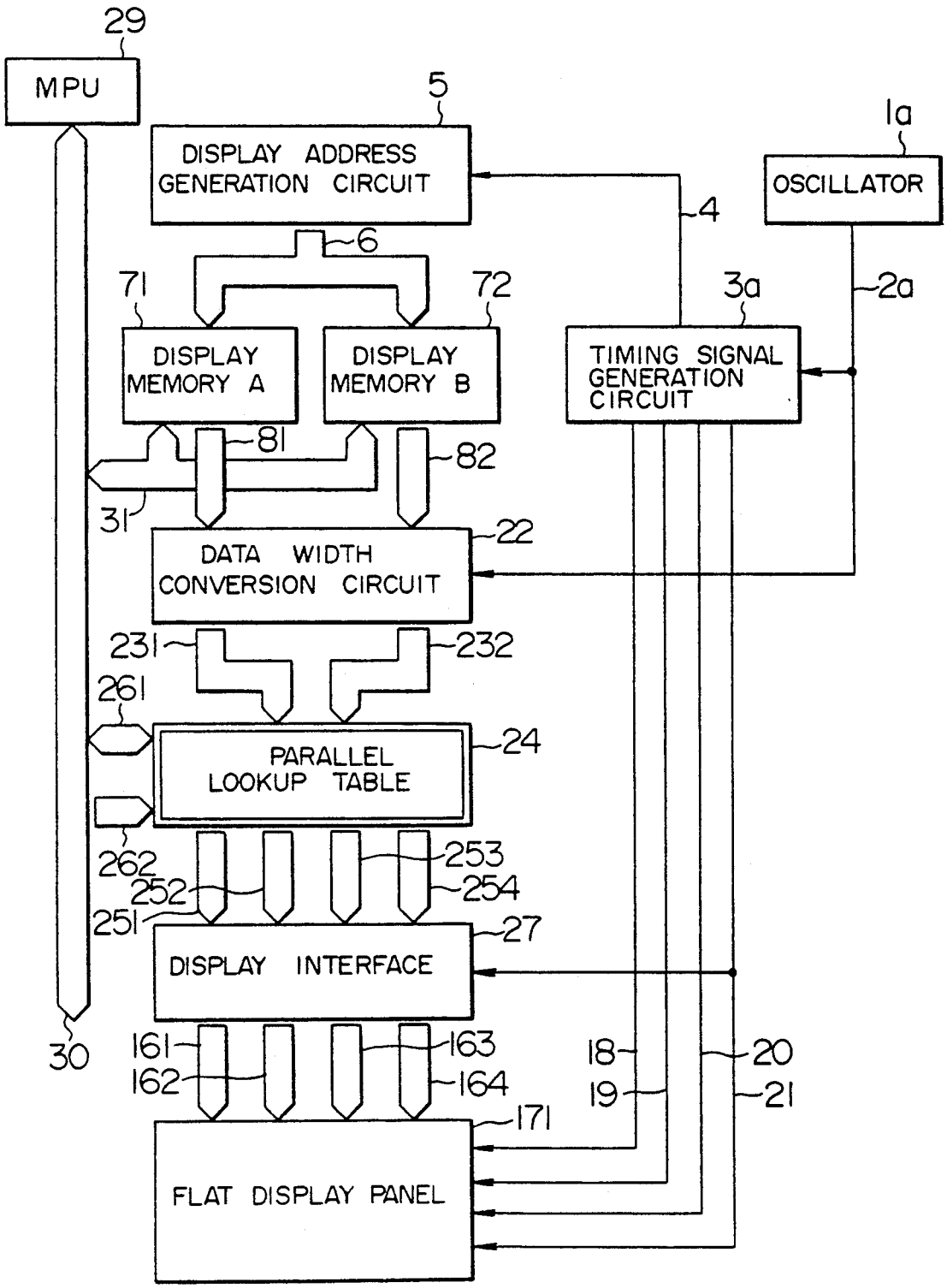
FIG. 4 is a block diagram of the display controller for a flat display panel based on an embodiment of this invention.

FIG. 4 is a block diagram of the display controller for a flat display apparatus based on an embodiment of this invention. In the figure, indicated by 1a is an oscillator which generates a base master clock signal **2*a*, a pulse being produced for each x dots (x is an integer greater than one), and 3*a* indicates a timing signal generation circuit which produces various timing signals from the master clock signal 2***a*. Reference numeral 22 indicates a data width conversion circuit, 231 and 232 refer to display block data of a x-dot width, and 24 identifies a parallel lookup table. Reference numerals 251 through 254 represent color data, and 27 indicates a display interface for delivering the color data 251–254 to a flat display panel 171.

Figure 1:
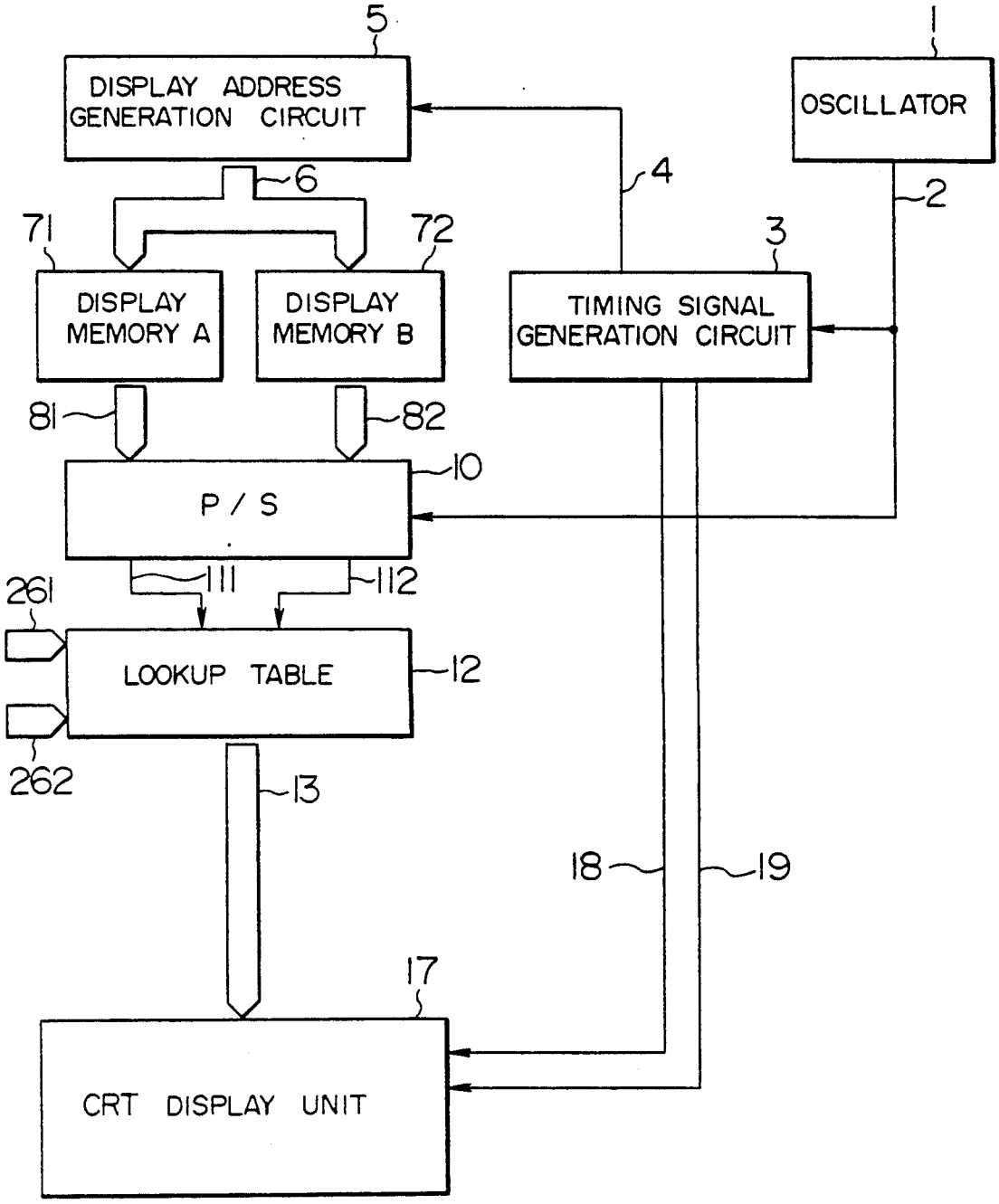
FIG. 1 PRIOR ART
FIG. 1 is a block diagram showing the arrangement of a conventional display controller.
Figure 2:
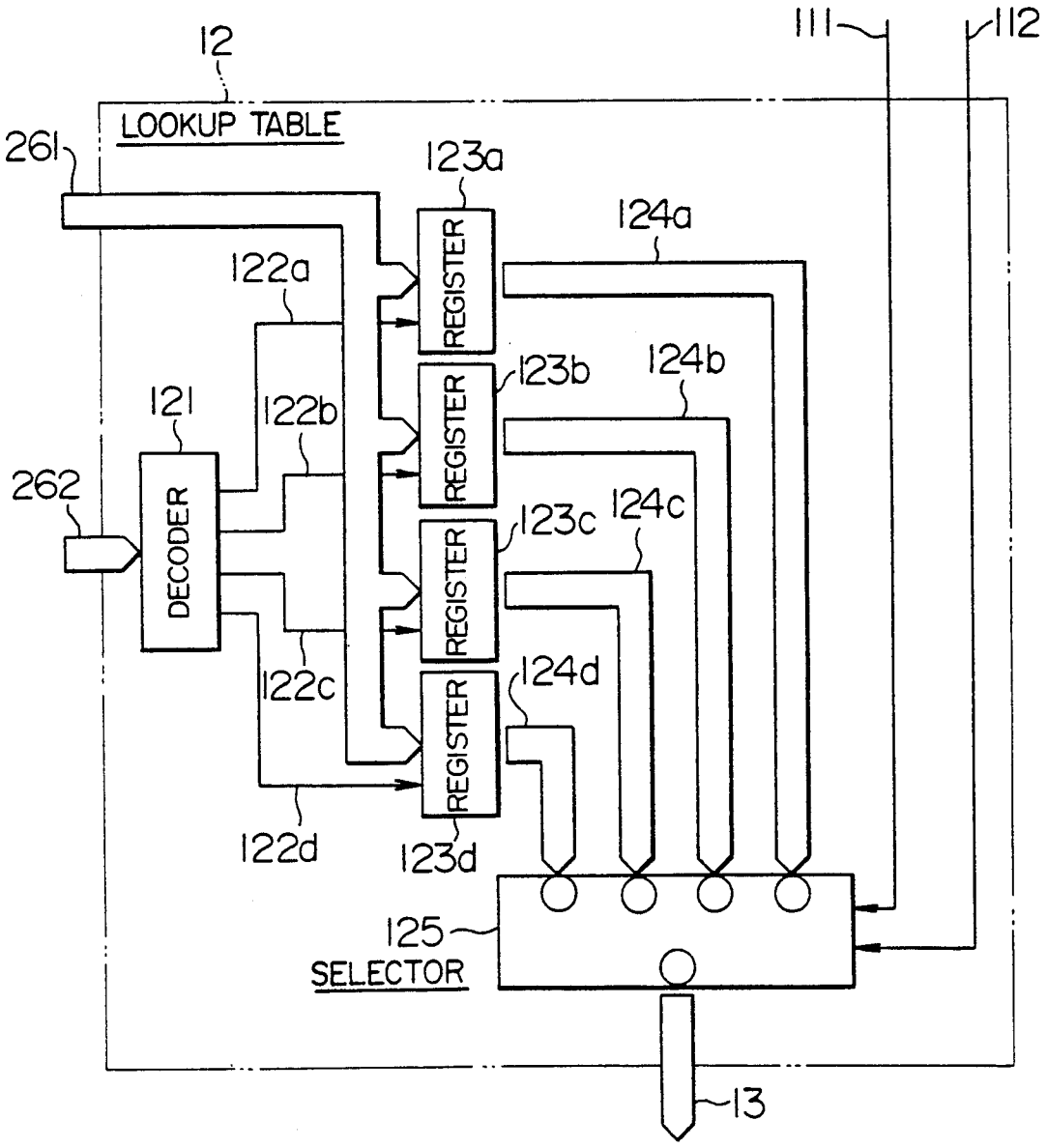
FIG. 2 PRIOR ART
FIG. 2 is a block diagram of the lookup table used in the arrangement of FIG. 1.
Figure 3:
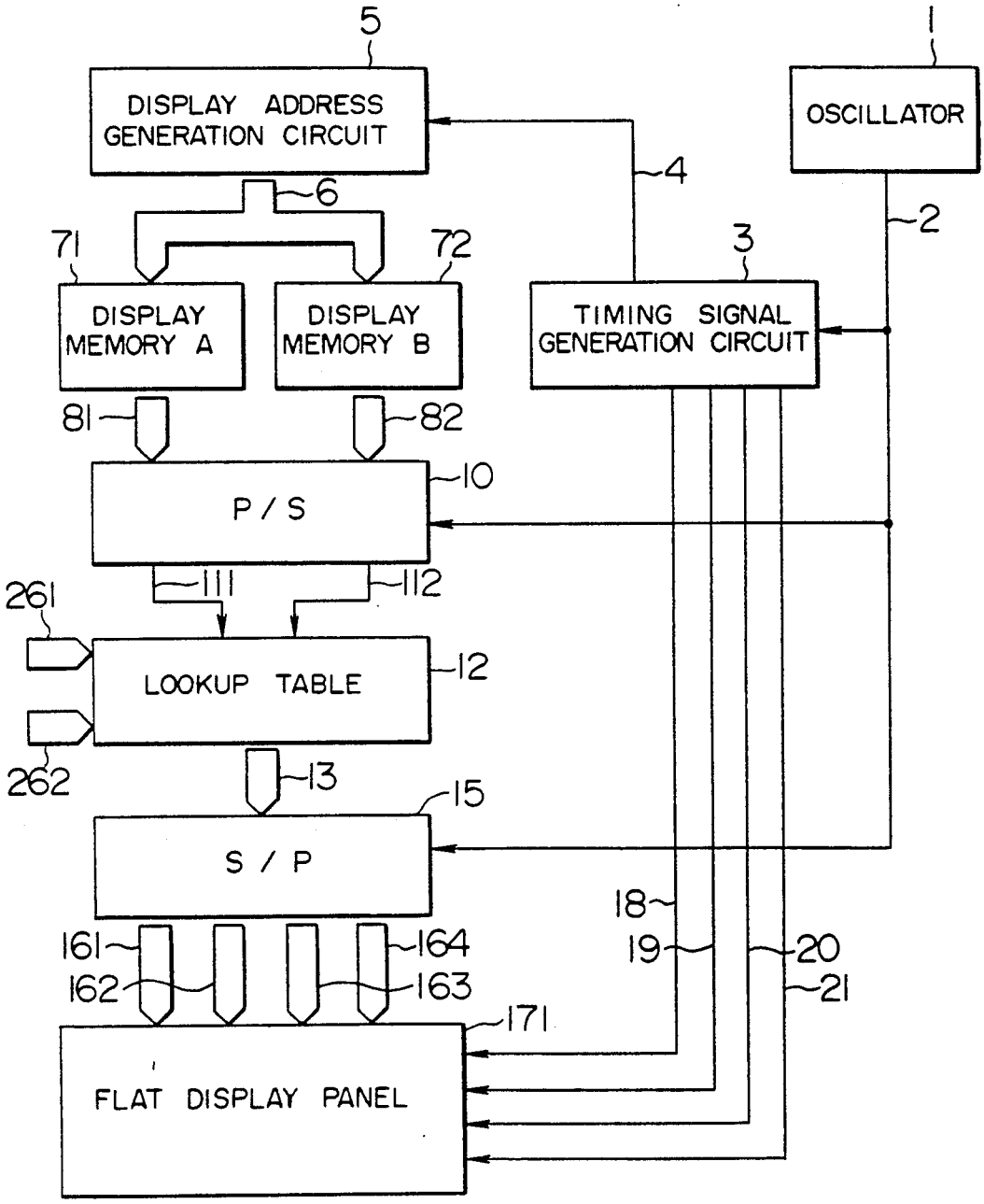
FIG. 3 PRIOR ART
FIG. 3 is a block diagram showing another conventional display controller.

Indicated by 29 is a MPU which controls the overall system, 30 indicates a signal bus through which the MPU 29 sends address, data and control signals to the circuit blocks. Reference numeral 31 identifies the address and data supplied to display memories 71 and 72, with display data being stored sequentially into these display memories by the MPU 29 in every vertical blanking period, for example. Portions identical to those of FIG. 1 and FIG. 3 are referred to by the same symbols and so their arrangement and operation will not be explained. For the simplicity of the following explanation, the number of dots x is fixed to four.

The data width conversion circuit 22 converts the 8-bit display data 81 and 82 read out of the display memories 71 and 72 into 4-bit data for every four dots to meet the input data format of the flat display panel 171 in response to the master clock 2*a*, and delivers the resulting block data 231 and 232 to the parallel lookup table 24. The parallel lookup table 24 responds to any of the four combinations of the four bits of block data 231 and 232, each having bit values of $2^1$ and $2^0$, to deliver selectively one of the preset four kinds of 4-bit color data 251–254.

Figure 5:
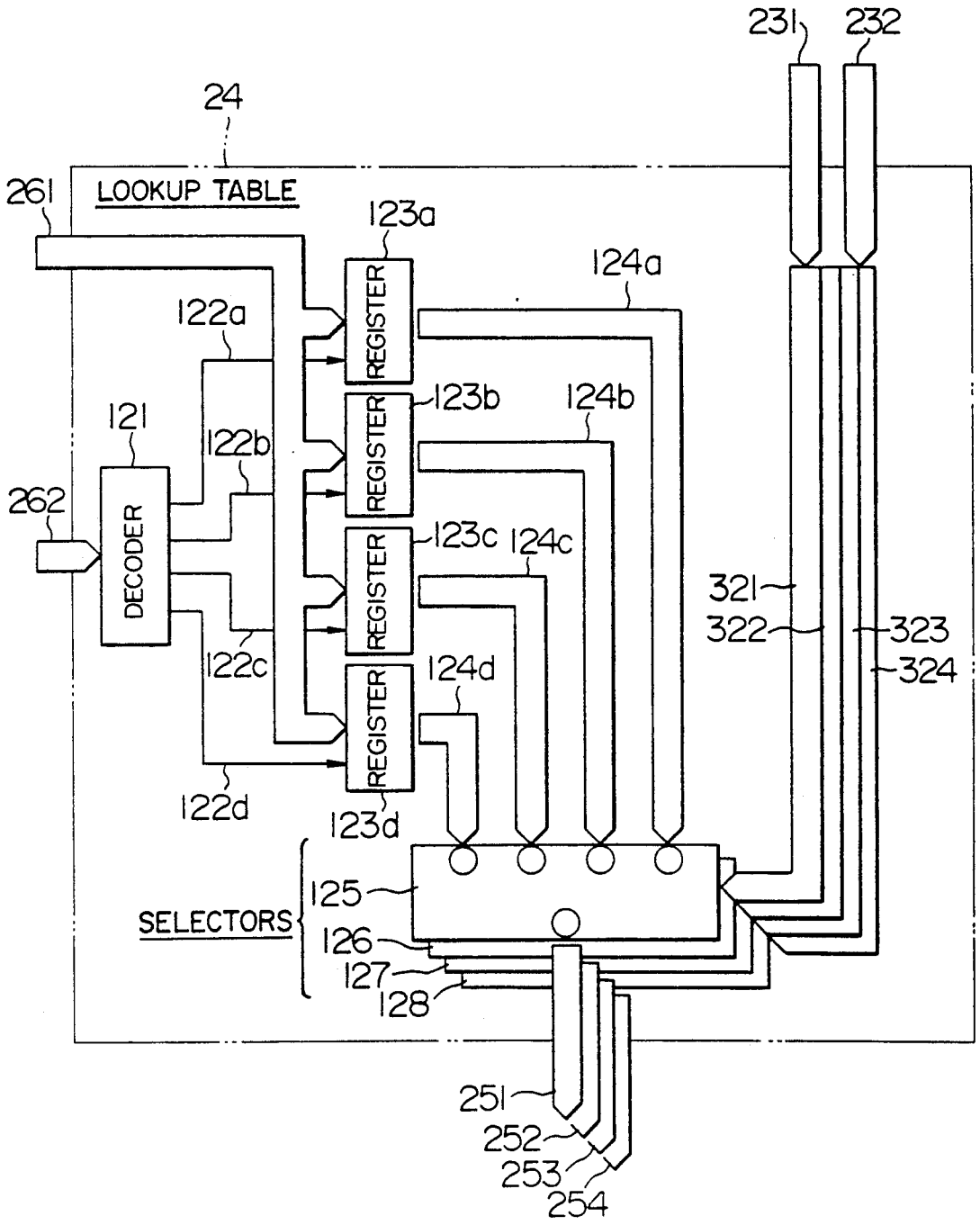
FIG. 5 is a block diagram of the parallel lookup table used in the arrangement of FIG. 4.

FIG. 5 shows the arrangement of the parallel lookup table 24, and it will be explained in conjunction with FIG. 4. In FIG. 5, indicated by 261 is color information provided by the MPU 29,262 indicates the address and control signals provided by the MPU 29,121 indicates a decoder which decodes the address and control signals 262 to produce four kinds of decoded outputs, 122*a*–122*d* identify write signals produced by the decoder 121, and 123*a*–123*d* are 4-bit registers each latching color information 261 by being strobed by the respective write signal 123*a*–123*d*. Accordingly, the MPU 29 provides certain values for the address and control signals 262 to set color information 261 out of 16 colors of 4-bit data selectively to one of the registers 123*a*–123*d*.

Indicated by 124*a* through 124*d* are 4-bit color information read out of the registers 123*a*–123*d*. Reference numeral 321 represents a 2-bit select signal derived made from the highest order bit (bit 3) of the block data 231 and 232, and similarly 322, 323 and 324 each represent 2-bit select signals derived from bit 2, bit 1 and bit 0, respectively, of the block data 231 and 232. Indicated by 125 is a selector which conducts selectively one of its four inputs 124*a*–124*d* in response to the 2-bit select signal 321, and similarly 126, 127 and 128 identify selectors for delivering ones of their four inputs in response to the respective select signals 322, 323 and 324. The color information 124*a*–124*d* is fed to the four selectors 125–128 in parallel, and one of them delivers color information as one of color data 251–254 in response to a specific bit combination of bits 3–0 of the block data 231 and 232, e.g., color information 124*a* for "00" 124*b* for "01" 124*c* for "10" and 124*d* for "11". Accordingly, the selectors 125–128 arranged in parallel deliver different color information as color data 251–254 in response to different two bit values of the select signals 321–324.

Assuming that bit 3 through bit 0 of the block data 231 and 232 are display data for the 4l-th dot, (4l+1)th dot, (4l+2)th dot and (4l+3)th dot (where Z is a positive integer), then the color data 251 is of the 4l-th dot, color data 252 is of the (4l+1)th dot, color data 253 is of the (4l+2)th dot and color data 254 is of the (4l+3) th dot. This circuit arrangement enables color data of four consecutive dots to be read out simultaneously and independently.

Returning to FIG. 4, the display interface 27 synchronizes the color data 251–254 read out of the parallel lookup table 24 with the data shift signal 21, and delivers the resulting color data 161–164 to the flat display panel 171. The flat display panel 171 receives the color data 161–164 as display data for the 4l-th dot, (4l+1)th dot, (4l+2)th dot and (4l+3)th dot (where l is a positive integer), and displays the data based on 16 kinds of color information carried by the four bits of each data.

According to this embodiment, the display controller has its internal process made 4-bit parallel, and the base clock frequency can be lowered to $\frac{1}{4}$. Although this embodiment is the case of the 4-bit parallel operation, it is possible to have the x-bit parallel operation through the provision of x sets of selectors in the parallel lookup table 24 (where x is an integer greater than 1) and through the operation of the oscillator 1*a* to generate a base clock pulse for every x dots and of the data width conversion circuit 22 to convert the display data 81 and 82 into x-bit width for every x dots, and consequently the base clock frequency can be lowered to 1/x.

By designing the flat display panel 171 to have its input data width made equal to the number of dots x of parallel processing, the serial-to-parallel conversion circuit can be eliminated.

Although in this embodiment the parallel lookup table 24 is formed of registers and selectors, this invention is not confined to this arrangement, but another hardware arrangement (e.g., using a memory) which simultaneously reads out multiple sets of color information that have been set by the MPU may be employed.

Figure 6:
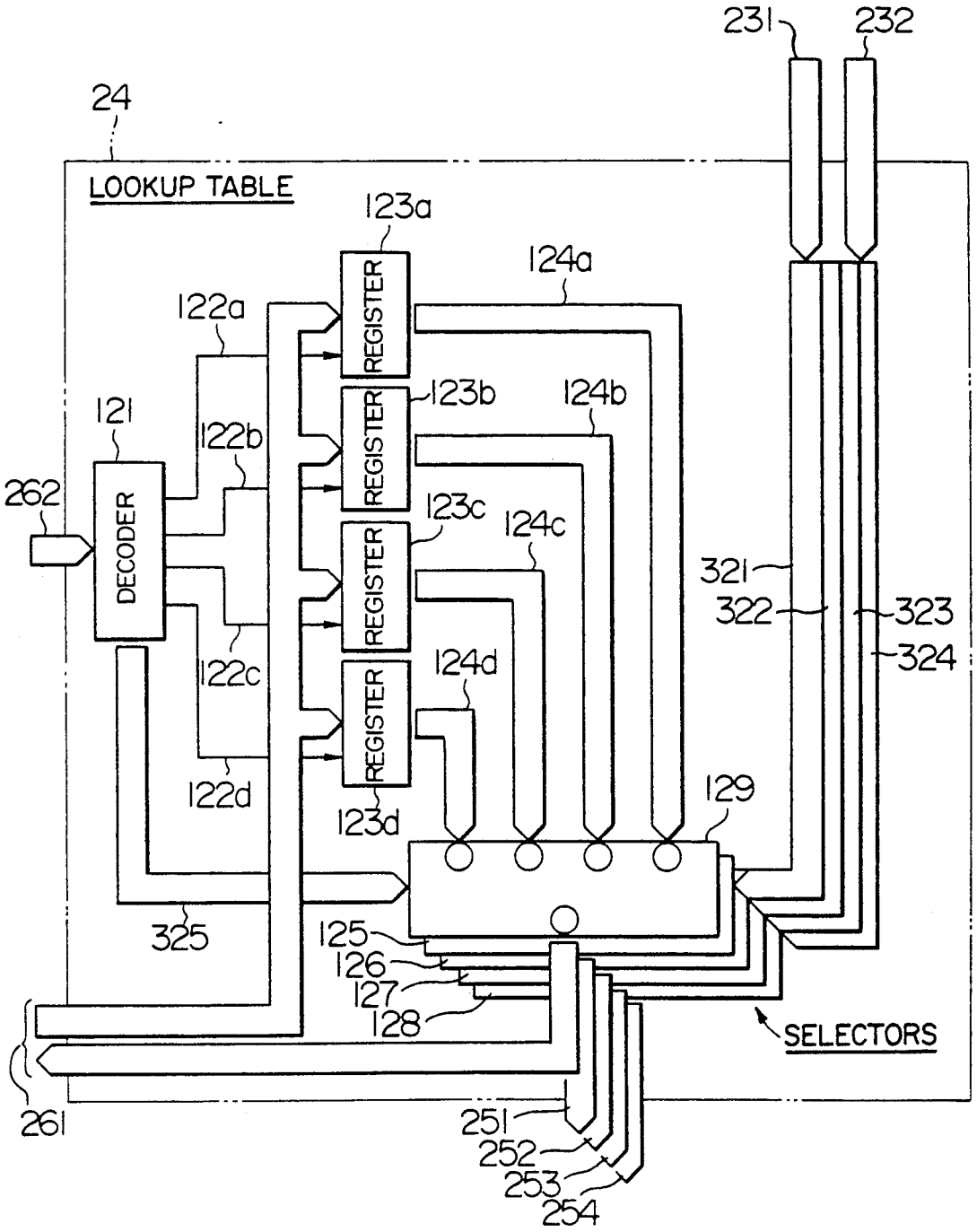
FIG. 6 is a block diagram showing a modified parallel lookup table as the second embodiment of this invention.

FIG. 6 shows the second embodiment of this invention which is a modification of the parallel lookup table 24 shown in FIG. 5. The parallel lookup table 24 of FIG. 6 has the provision of an independent selector 129 for read access made by the MPU 29. The basic operation of the parallel lookup table 24 is identical to that of FIG. 5. The decoder 121 decodes the address and control signals 262 and delivers the write signals 122*a*–122*d* to the respective registers 123*a*–123*d* and the read select signal 325 to the selector 129.

The selector 129 delivers selectively one of the color information 124*a*–124*d* in response to the value of the select signal 325, which is comparable to the select signals 321–324, to the remaining four selectors 125–128. The MPU 29 sets certain values to the address and control signals 262 thereby to select any of the registers 123*a*–123*d* for writing or reading the color information 261 for it. According to the second embodiment, the base clock frequency can be lowered through the parallel operation and the emergence of display noises due to a MPU read access can be suppressed.

Next, the third embodiment of this invention will be explained in detail. The applicant of the present invention has proposed in the aforementioned Japanese Patent Unexamined Publication No. 62-161194 the arrangement for reducing screen noises which emerge at a read access to the lookup table. The following embodiment of the present invention is to devise the reduction of screen noises caused by a MPU read access in a x-bit parallel circuit configuration.

Figure 7:
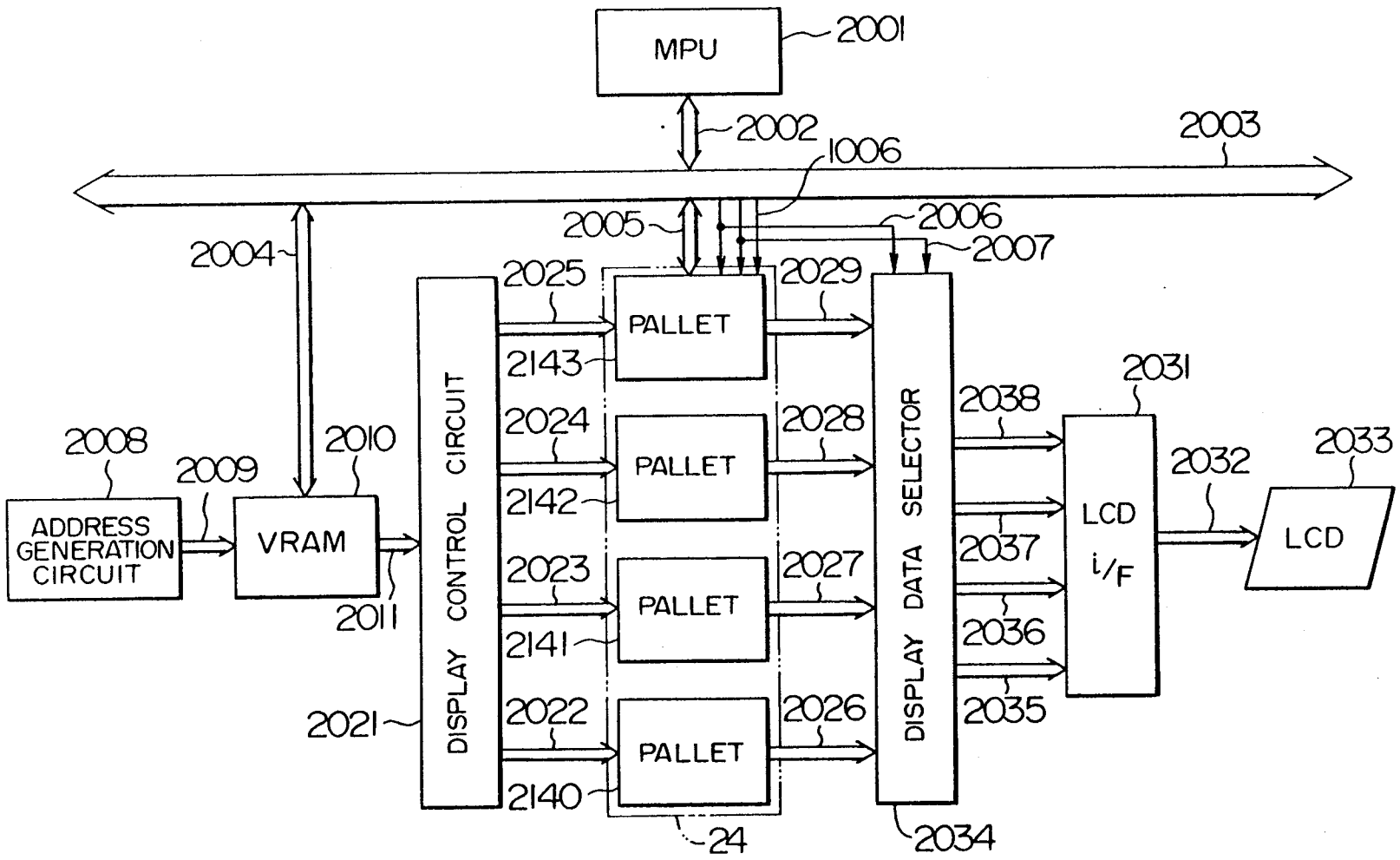
FIG. 7 is a block diagram of the display controller based on the third embodiment of this invention.

FIG. 7 is a block diagram showing the third embodiment of this invention which shares the basic arrangement with FIG. 4. Indicated by 2001 is a MPU, 2003 represents a signal bus, and 2008 represents an address generation circuit which compares with the display address generation circuit 5 in the preceding embodiment. A VRAM 2010 compares with the display memories (A, B) 71 and 72, and a display control circuit 2021 compares with the data width conversion circuit 22 and timing signal generation circuit 3*a*, etc. of the preceding embodiment. Paletts 2140–2143 form the parallel lookup table 24 in the preceding embodiment. A LCD interface 2031 compares with the display interface 27, and a LCD panel 2033 compares with the flat display panel 171 of the preceding embodiment. A feature of this embodiment is the provision of a display data selector 2034 for switching pallet output data between the pallets 2140–2143 and the LCD interface 2031.

Figure 8:
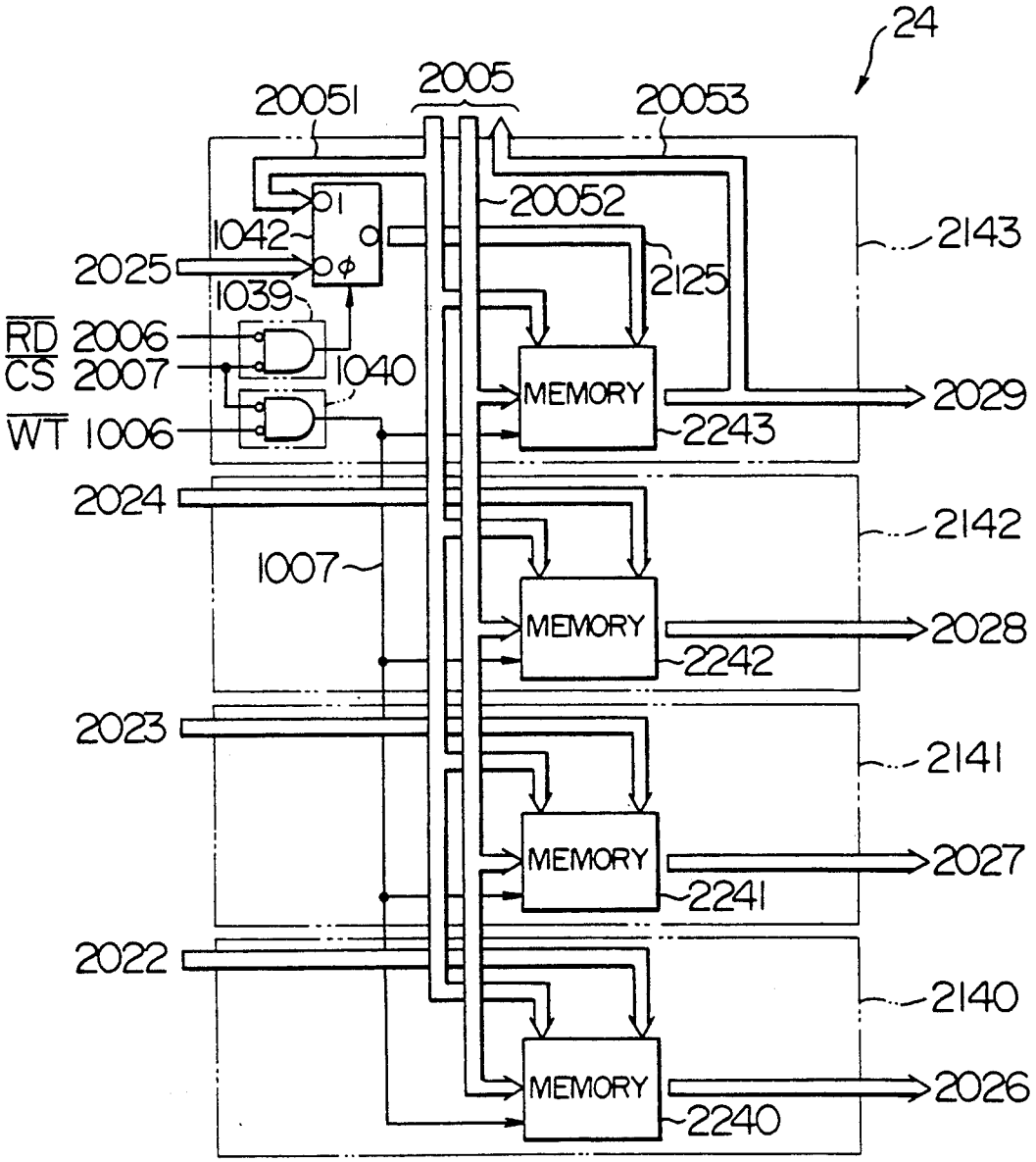
FIG. 8 is a detailed block diagram of the parallel lookup table used in the arrangement of FIG. 7.

FIG. 8 shows the arrangement of the parallel lookup table formed of the pallets 2140–2143. Each pallet has a pair of ports including a write port and a read port and a memory 2240 (-2243) of the same capacity. Indicated by 20051 is the address signal, 20052 represents the writing color information, 20053 is the reading color information, 1006 represents the write signal, and 1042 represents a selector for switching the read address 2125 of the memory 2243 depending on the output of an AND gate 1039. When the MPU 2001 makes a write access to the parallel lookup table 24, the write signal 1006 and chip select signal 2007 become active, the memory write signal 1007 is activated by the AND gate 1040, and the same color information is written to the same address of the memories 2240–2243 in the parallel lookup table 24. When the MPU 2001 makes a read access to the parallel lookup table 24, the read signal 2006 and chip select signal 2007 become active, the selector 1042 switches, the MPU issues an address 20051 for the read address 2125, and the color information 20053 (2029) is read out.

Figure 9:
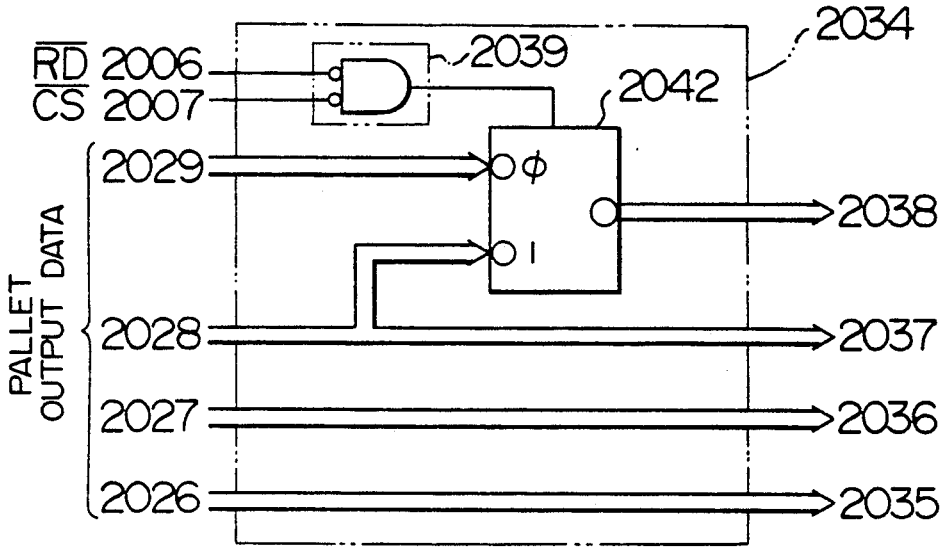
FIG. 9 is a block diagram of the display data selector used in the arrangement of FIG. 7.

FIG. 9 shows a specific arrangement of the display data selector 2034 in FIG. 7. Indicated by 2039 is an AND gate for detecting the read signal 2006 and chip select signal 2007 issued by the MPU to the pallet, and 2042 represents a selector for switching the pallet output data depending on the output of the AND gate 2039.

FIG. 10(b) is a timing chart showing the operation of the display data selector shown in FIG. 9.

In displaying the display data 2011 which has been stored in the VRAM 2010 by the MPU 2001 on the LCD panel 2033 in FIG. 7, the display data is read out of the VRAM 2010 and, after it has been subjected to the blanking and masking process by the display control circuit 2021, it is entered to the pallets 2140–2143, which then deliver data 2026–2029 corresponding to the entered display data 2022–2025.

Figure 10:
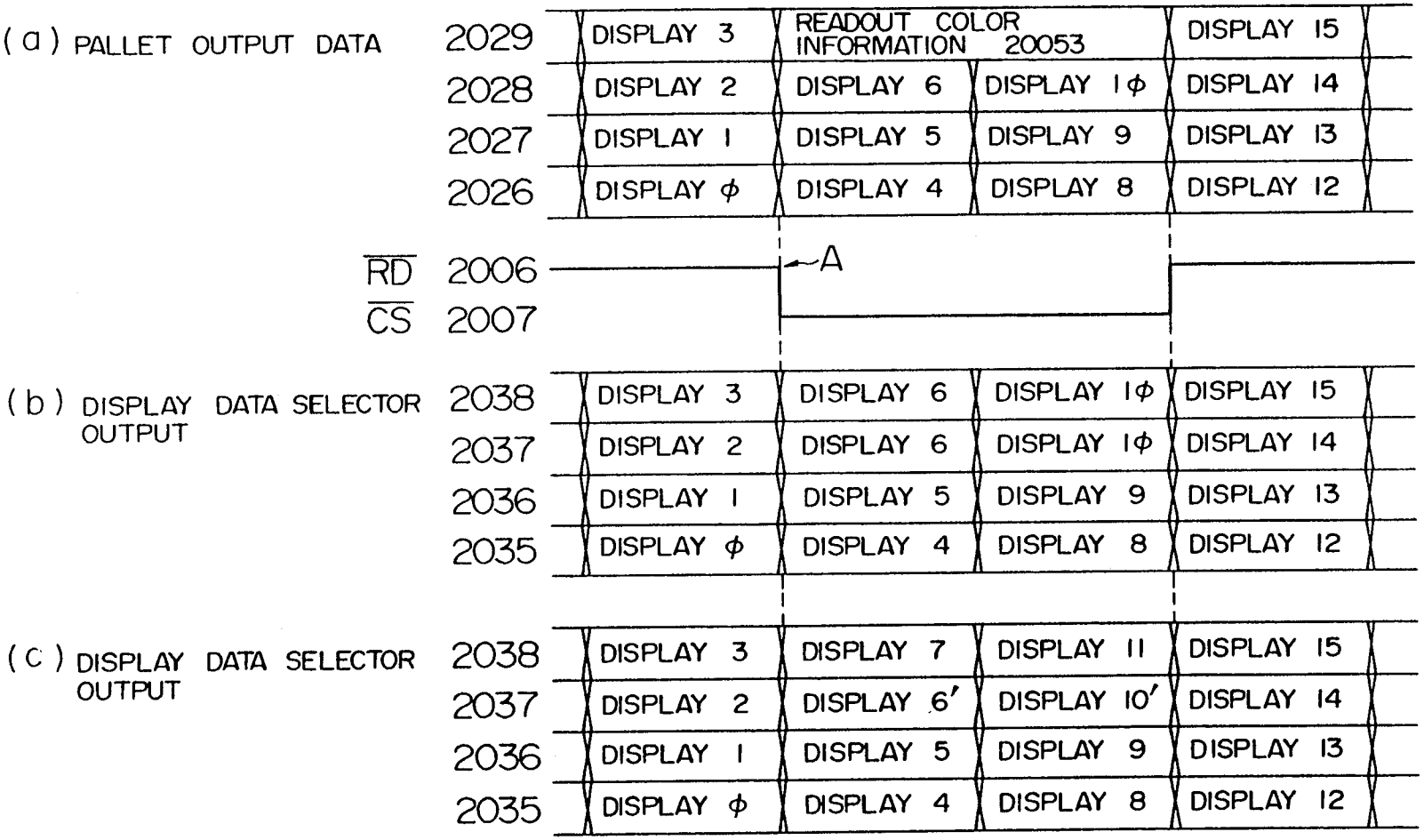
FIG. 10 is a timing chart showing the operation of the display data selector.

The operation followed by a read access made by the MPU 2001 to the pallet 2143 during the display period will be explained with reference to FIGS. 9 and 10. With the read signal 2006 and chip select signal 2007 becoming active, the AND gate 1039 operates on the selector 2042 to deliver the output data 2028 for the display data 2038. In contrast to the usual readout operation shown in FIG. 10(*a*), the operation shown in FIG. 10(*b*) has the pallet access starting at point A, and "display 6" and "display 10" are placed in a location where the readout color information 20053 of the MPU (FIG. 10(*a*)) is normally placed. By replacing the display data from the pallet accessed by the MPU 2001 with the display data provided by another pallet, the display data is prevented from being collapsed by the data resulting from a read access by the MPU. In this manner, the display data of a pallet next to an accessed pallet is delivered as the display data for the accessed pallet, and the emergence of screen noises can be reduced.

In this embodiment, in which data is read out of the pallet 2143 for the data of the MPU read access, the display data 2038 is provided by switching the pallet output data 2028 and 2029, but this invention is not confined to this scheme. For example, in a circuit arrangement where the pallet read out in response to the MPU read access is the pallet 2142, the pallet output data 2027 and 2028, or 2029 and 2028 are entered to the selector. The pallet output data which is delivered by switching during the MPU read access is of any pallet which either precedes or follows the pallet to be read out.

Figure 11:
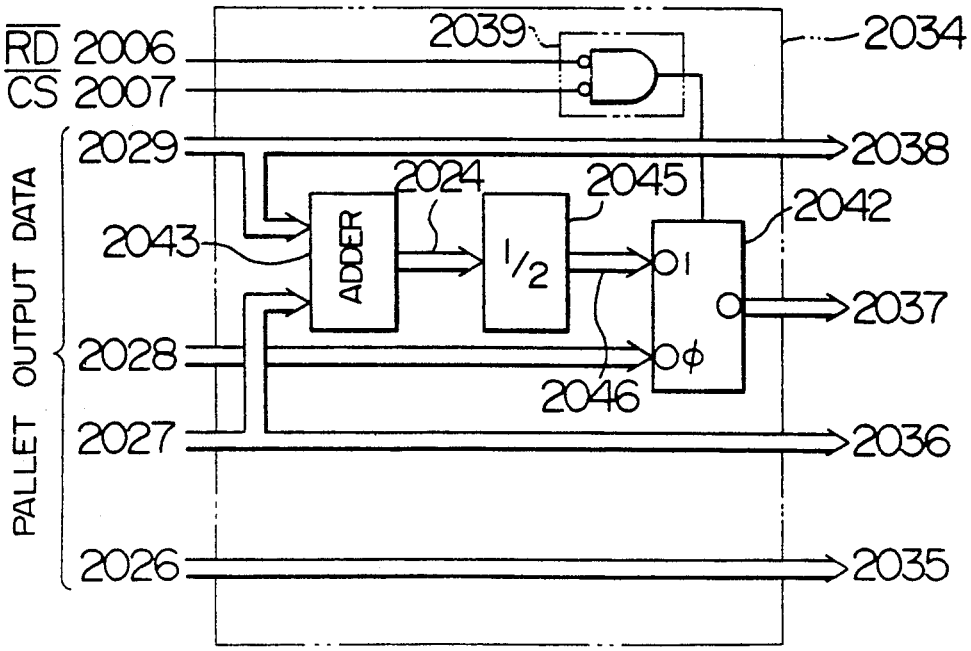
FIG. 11 is a block diagram of the display data selector based on the fourth embodiment of this invention.

The fourth embodiment of this invention is the arrangement of the display data selector 2034 as shown in FIG. 11 for the display controller of the third embodiment shown in FIG. 7. FIG. 10(*c*) is a timing chart showing the display operation based on the display data selector of FIG. 11.

In FIG. 11, indicated by 2039 is an AND gate for detecting the read signal and chip select signal 2007 issued by the MPU to the pallet, 2043 represents an adder which sums the pallet output data 2029 and 2027 of pallets which precedes and follows the pallet of the MPU read access, 2045 represents a circuit which halves the summed data 2044, and 2042 represents a selector which switches pallet output data to be delivered depending on the output of the AND gate 2039. In the second embodiment, it is assumed that the MPU makes a read access to read pallet data out of the pallet 2142 which delivers the pallet output data 2028.

The display operation when the MPU has made a read access to the pallet 2142 during the display period will be explained with reference to FIG. 11 and FIG. 10(*c*). With the read signal 2006 and chip select signal 2007 becoming active, the AND gate 2039 switches the selector 2042 so that it delivers the display data 2037 by summing the pallet output data 2027 and 2029 and dividing the result by two, i.e., a mean value of these pallet output data, of the pallets 2141 and 2143 which precedes and follows the pallet 2142. In the example of FIG. 10 (*c*), the pallet access starts at point A, and mean value "display 6'" of "display 7" and "display 5" and mean value "display 10'" of "display 11" and "display 9" are placed in location where the readout information 20053 is normally placed. In the second embodiment, display data of a pallet adjacent to the readout pallet is delivered intact for the MPU read access display data, whereas in the third embodiment, a mean value of display data of both adjacent pallets is delivered, which equalizes the change in tone between both adjacent display data, and consequently it becomes possible to reduce the emergence of screen noises. In the example shown in FIG. 11, in which data is read out of the pallet 2142 at a read access, the display data 2037 is provided by switching between the pallet output data 2028 and a mean value of the pallet output data 2027 and 2029, and the pallet read out by the MPU read access and the pallet output data to be entered to the selector are not confined to this embodiment. Instead, the circuit arrangement may be such that the pallet output data which is delivered by switching during the MPU read access is a mean value of output data of both pallets which precedes and follows the readout pallet. However, the circuit arrangement of this embodiment is effective only for monochrome display data and it cannot deal with color display data.

Figure 12:
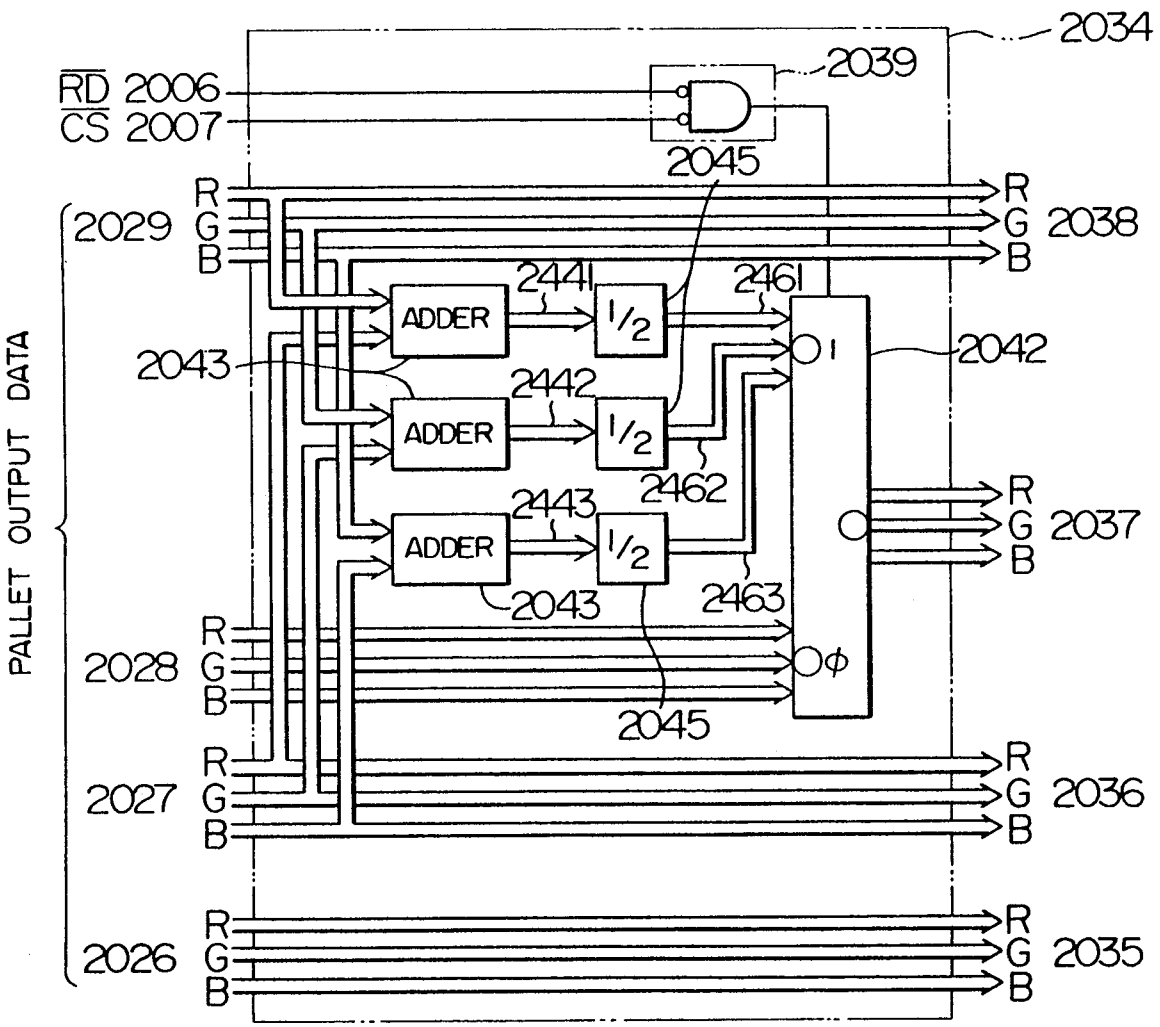
FIG. 12 is a block diagram of the display data selector based on the fifth embodiment of this invention.

The fifth embodiment of this invention is the arrangement of the display data selector 2034 as shown in FIG. 12 for the display controller of the fourth embodiment. The timing chart of FIG. 10(*c*) also shows the display operation based on the display data selector of FIG. 12.

The fifth embodiment differs from the fourth embodiment in the display data selector 2034 which is intended for color display data, in contrast to that of the preceding embodiment for monochrome display data. Color display data consists of three color components including red (R), green (G) and blue (B), as shown in FIG. 12. On this account, the pallets are designed to deliver the RGB components, and averaging circuits are provided to deal with the R, G and B components independently. For a read access to the pallet 2142 during the display period, mean values of the pallet output data 2027 and 2029 of the pallets 2141 and 2143 before and after the readout pallet 2142 evaluated for the R, G and B components separately are delivered for the display data 2037. According to the fourth embodiment, mean values of display data of adjacent pallets are evaluated for the R, G and B components separately and delivered for the output display data of the pallet at the MPU read access, and consequently it becomes possible to reduce the emergence of screen noises. In the example of FIG. 12, in which data is read out of the pallet 2142 at the MPU read access, the display data 2037 is delivered by switching between the pallet output data 2028 and the mean value of the pallet output data 2027 and 2029, but, the pallet which is read out for the MPU read access and the pallet output data to be entered to the selector are not confined to the manner of this embodiment. Instead, the circuit arrangement may be such that the pallet output data which is delivered by switching during the MPU read access is a mean value of output data of both pallets which precedes and follows the readout pallet.

Figure 13:
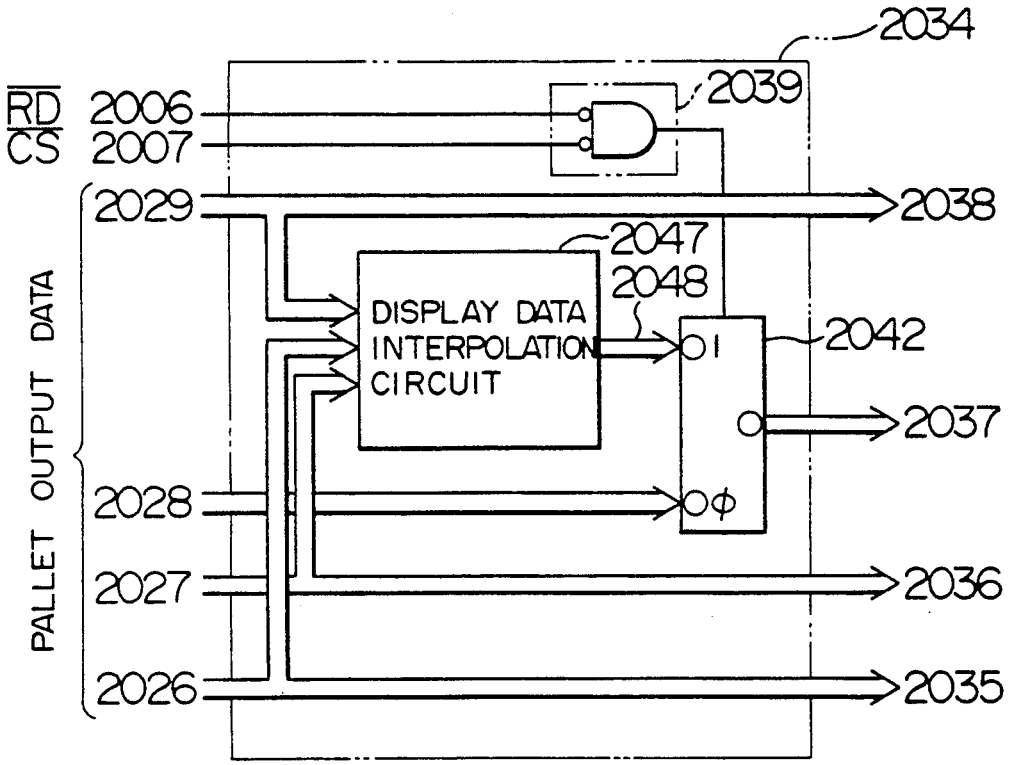
FIG. 13 is a block diagram of the display data selector based on the sixth embodiment of this invention.

The sixth embodiment of this invention is the arrangement of the display data selector 34 as shown in FIG. 13 for the display controller of the fourth embodiment. The timing chart of FIG. 10(*c*) also shows the display operation based on the display data selector of FIG. 13.

In FIG. 13, indicated by 2039 indicates an AND gate for detecting an access to a pallet, 2047 is a circuit which evaluates the value of the pallet output data 2028 through the interpolation of values of the pallet output data 2029, 2027 and 2026, and 2042 indicates a selector which switches pallet output data to be delivered depending on the output of the AND gate 2029. In this circuit arrangement, when the MPU makes a read access to the pallet 2142 during the display period, the AND gate 2039 which detects a read access to the pallet operates on the selector 2042 so that data 2048, which is produced by interpolation of output data 2029, 2027 and 2026 of all pallets that are not read out, is delivered for the display data 2037. In the example of FIG. 10(*c*), the pallet access starts at point a, and "display 6'" resulting from the interpolation of "display 4", "display 5" and "display 7", and "display 10'" resulting from the interpolation of "display 8", "display 9" and "display 11" is placed in a location where readout information 20053 of the MPU is normally placed. In this manner, the output display data for the pallet of the MPU read access is replaced by data which is evaluated by interpolation of display data of adjacent pallets so that data which is approximate to the inherent output display data is delivered, whereby the emergence of screen noises can be reduced. In the example of FIG. 11, in which data is read out of the pallet 2142 at the MPU read access, the output data 2037 is delivered by switching between the pallet output data 2028 and the interpolated data 2048, however, the pallet which is read out for the MPU read access and the pallet output data to be entered to the selector are not confined to the manner of this embodiment. However, the circuit arrangement of this embodiment is effective only for monochrome display data and it cannot deal with color display data.

Figure 14:
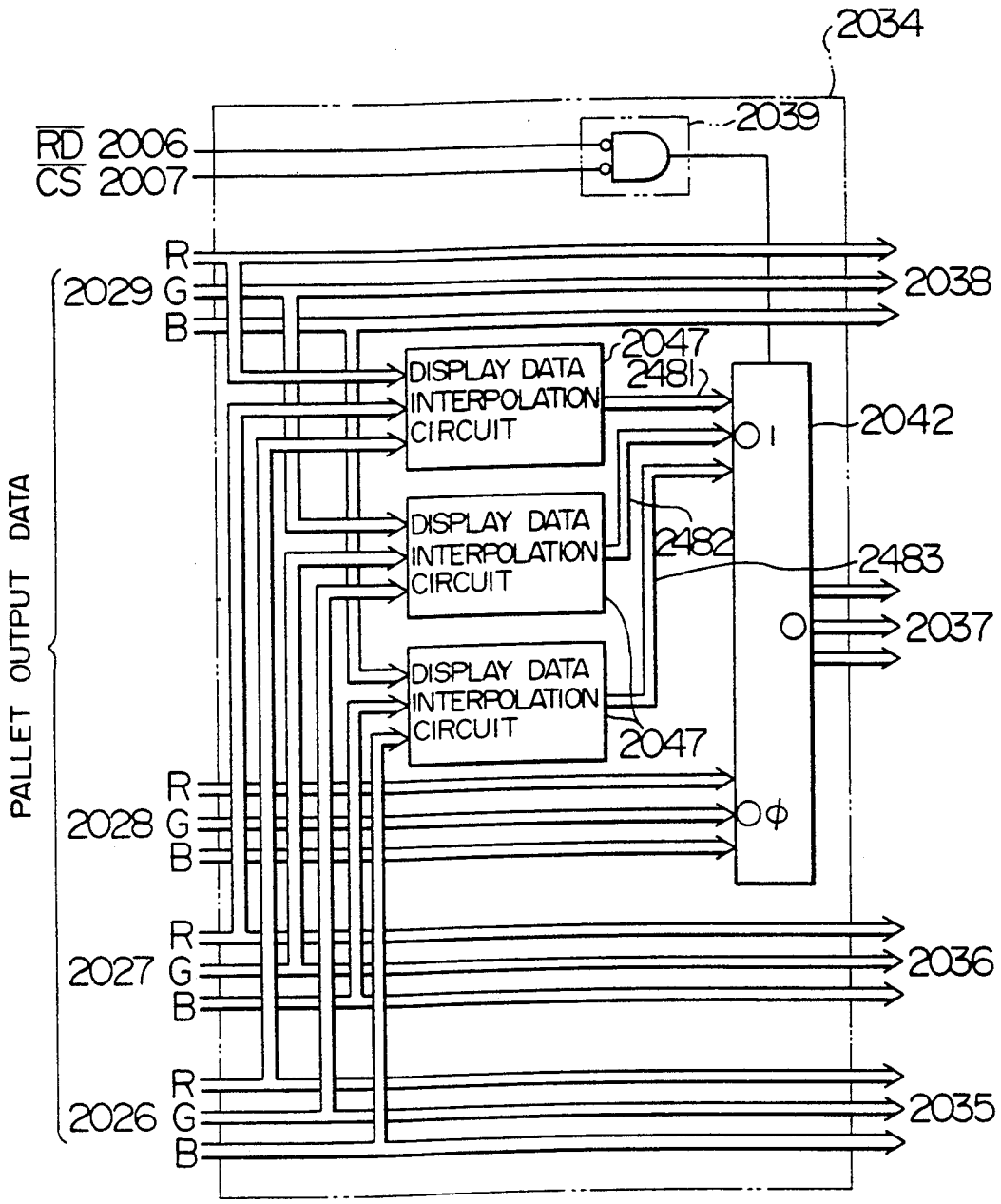
FIG. 14 is a block diagram of the display data selector based on the seventh embodiment of this invention.

The seventh embodiment of this invention is the arrangement of the display data selector 34 as shown in FIG. 14 for the display controller of the sixth embodiment. The timing chart of FIG. 10(*c*) also shows the display operation based on the display data selector of FIG. 14.

The seventh embodiment differs from the sixth embodiment in the display data selector 2034 which is intended for color display data, in contrast to that of the preceding embodiment for monochrome display data. Color display data consists of three color components including red (R), green (G) and blue (B), as shown in FIG. 14. On this account, display data interpolation circuits 2047 are provided to deal with the R, G and B components independently. For a read access to the pallet 2142 during the display period, data 2481, 2482 and 2483 produced by interpolation for the R, G and B components of output data 2029, 2027 and 2026 of pallets which are not read out by the MPU are delivered for the display data 2037. According to the seventh embodiment, data resulting from interpolation of display data of the adjacent pallets are evaluated for the R, G and B components separately and delivered for the output display data of the pallet at the MPU read access so that data which is approximate to the inherent output display data is delivered, and consequently it becomes possible to reduce the emergence of screen noises. In the example of FIG. 14, in which data is read out of the pallet 2142 at the MPU read access, the display data 2037 is delivered by switching between the pallet output data 2028 and the interpolated data 2481, 2482 and 2483, however, the pallet which is read out for the MPU read access and the pallet output data to be entered to the selector are not confined to the manner of this embodiment. Instead, the circuit arrangement may be such that the pallet output data which is delivered by switching during the MPU read access is data which is evaluated by interpolation of the R, G and B components of other pallets adjacent to the readout pallet.

Figure 15:
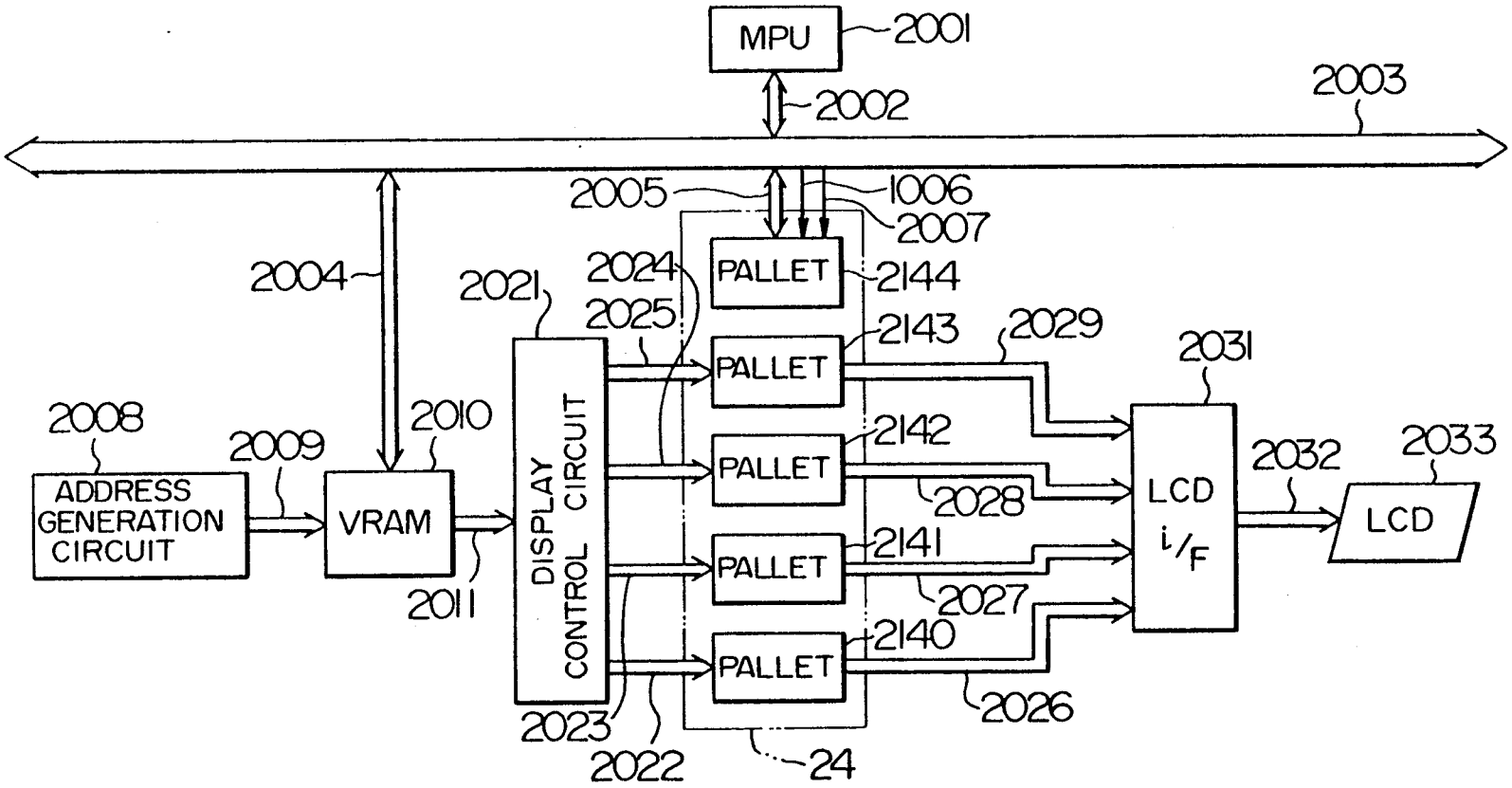
FIGS. 15 and 16 are a block diagram of the display controller based on the eighth embodiment of this invention and a detailed block diagram of the parallel lookup table used in it.
Figure 16:
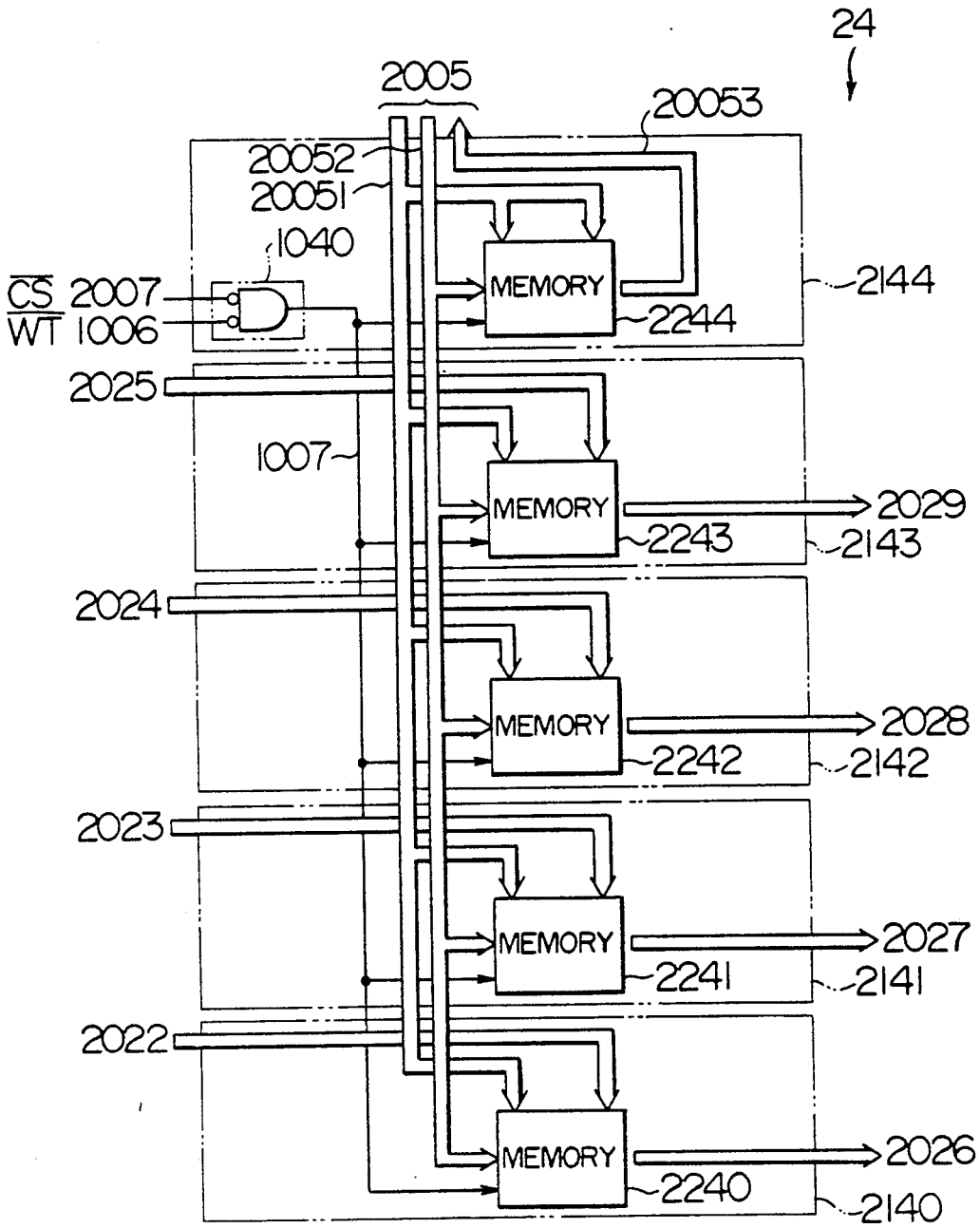

FIG. 15 and FIG. 16 show the eighth embodiment of this invention. A feature of this embodiment is the provision, in the parallel lookup table 24, of a pallet 2144 which is dedicated to the access from the MPU 2001. In the arrangement of the parallel lookup table 24 shown in detail in FIG. 16, the MPU-access-only pallet 2144 is provided independently of the four pallets 2140–2143 which process display color information to the flat display panel, and therefore the read access made by the MPU 2001 does not affect the display color information. Accordingly, the AND gates 1039 and 1042 provided for the pallet to which read access is made, as shown in FIG. 8, are no longer necessary. Moreover, the output of the parallel lookup table 24 can be delivered intact to the flat display panel 2203, and therefore the display data selector 2034 shown in FIG. 7 is not necessary.

Although the foregoing embodiments are of the case of a 4-bit parallel circuit arrangement, the present invention is equally applicable to other parallel circuit arrangements of 2 bits or more, such as of the 6-bit parallel and 8-bit parallel operations.

According to the embodiments of this invention described above in detail, the display circuit has its base clock frequency lowered to $\frac{1}{2}$ of the dot clock frequency (in 2-bit parallel operation), $\frac{1}{4}$ of the dot clock frequency (in 4-bit parallel operation), or 1/x of the dot clock frequency (in x-bit parallel operation), whereby a fine display controller which needs a dot clock as high as 100 MHz can readily be fabricated as a LSI deivce.

In the display circuit of the k-bit ($k \geqq 2$) parallel configuration, when the MPU makes a read access to the lookup table during the display period, the display data for the n-th ($n \leqq k$) lookup table in the MPU read access is replaced with the display data of the $(n+1)$th or $(n-1)$th lookup table, and the emergence of screen noises can be reduced.

Alternatively, the display data of the n-th lookup table is replaced with a mean value of the $(n+1)$th and $(n-1)$th display data, which equalizes the change in tone or color between the $(n-1)$th and n-th display data and between the n-th and $(n+1)$th display data, and the emergence of screen noises can be reduced.

Alternatively, by delivering the display data for the n-th lookup table through the interpolation of display data of the first, second, . . . , $(n-1)$th, $(n+1)$th, . . . , and k-th lookup tables, display data which is approximate to the display data of the n-th lookup table to be displayed inherently is displayed, and the emergence of screen noises can be reduced.

We claim:

1. A display controller for a flat display apparatus comprising:

a display address generation circuit which generates display addresses sequentially;

a display memory which stores pixel display data and reads out said pixel display data in response to a display address provided by said display address generation circuit;

a parallel lookup table which converts pixel display data read out of said display memory into color designating data for a respective pixels with a data format to be output to a display device; and a flat display device which displays an image made up of a plurality of pixels from the data provided by said parallel lookup table;

wherein said parallel lookup table comprises:

a plurality of lookup table devices including n memory devices (where n is an integer greater than one) each for storing color pixel designating information; and m selectors (where m is an integer greater than one), each connected to said n memory devices independently, for receiving n pieces of color pixel designating information stored in said n memory devices and for outputting m pieces of color pixel designating information for m pixels simultaneously by each selector selecting one from said n pieces of color pixel designating information according to said pixel display data read out of said display memory, wherein said m pieces of color pixel information corresponds to display data to be displayed on said flat display apparatus of an adjacent m pixels.

2. A display controller according to claim 1, wherein said parallel lookup table further comprise selection means, which is independent of said m selectors, for receiving n pieces of pixel color designating information read out of said n memory devices, and delivering pixel color designating information read out of an arbitrary memory device selectively in response to a read access made by a processor which implements the system control for the display controller of the flat display apparatus.

3. A display controller according to claim 1, wherein said m pieces of pixel color designating information of said parallel lookup table have a data width equal to the input data width of said flat display device.

4. A display controller according to claim 1, wherein said parallel lookup table comprises k pallets (where $k \geqq 2$), which are arranged in parallel, each adapted to store pixel color designating information and select a piece of pixel color designating information independently in response to pixel display data received from said display memory, and deliver k pieces of pixel color designating information simultaneously, and wherein said display controller comprises a data selector which receives output data of said k pallets and delivers the output of another pallet, in place of the pallet to which the read access is made, to said flat display device.

5. A display controller according to claim 4, wherein said data selector delivers, for display data of the n-th (where $n \leqq k$) pallet, to which the read access is made, output data of either $(n+1)$th or $(n-1)$th pallet adjacent to said n-th pallet.

6. A display controller according to claim 4, wherein said data selector delivers, for display data of the n-th (where $n \leqq k$) pallet, to which the read access is made, any of averaged data of display data of the adjoining $(n+1)$th pallet and $(n-1)$th pallet, averaged data of display data of the adjoining $(n+1)$th pallet and $(n+2)$th pallet, or averaged data of display data of the adjoining $(n-1)$th pallet and $(n-2)$th pallet.

7. A display controller according to claim 6, wherein said pixel color designating information is processed for the R, G and B signals independently, and the averaging process for the pallet, to which the read access is made, is implemented for the R, G and B signals independently.

8. A display controller according to claim 4, wherein said data selector delivers, for display data of the n-th (where $n \leqq k$) pallet, to which the read access is made, data produced through the interpolation of output data of all pallets excluding the n-th pallet.

9. A display controller according to claim 8, wherein said pixel color designating information is processed for the R, G and B signals independently, and the averaging process for the pallet, to which the read access is made, is implemented for the R, G and B signals independently.

10. A display controller according to claim 1, wherein said parallel lookup table comprises k pallets (where $k \geqq 2$), which are arranged in parallel, each adapted to store multi-bit color designating information and select a piece of pixel color designating information independently by receiving pixel display data from said display memory, and deliver k pieces of pixel color designating information simultaneously, and an independent pallet which delivers pixel color designating information, which has been stored in response to a read access made by a processor that implements the system control of the display controller of the flat display apparatus, to said processor.

11. A display controller for a flat display apparatus according to claim 1, wherein said parallel lookup table comprises n (n is an integer greater than 1) memories each storing n pieces of color pixel designating information, outputs one of said n pieces of color pixel designating information thus stored, m pieces of selected signals from among said pixel display data output from said display memory are provided to each of said n memories as an address, said m pieces of select signals from among said pixel display data correspond to display data to be displayed on said flat display apparatus.

* * * * *